US008747138B2

(12) United States Patent
Brune et al.

(10) Patent No.: US 8,747,138 B2
(45) Date of Patent: Jun. 10, 2014

(54) PLUG CONNECTION ASSEMBLY FOR A MOISTURE-PROTECTED ELECTRICAL PLUG CONNECTION

(75) Inventors: Dominik Brune, Ostbevern (DE); Andreas Hanke, Osnabrück (DE); Juri Bugajew, Ibbenbüren (DE); Reinhard Hembrock, Hörstel (DE)

(73) Assignee: OASE GmbH, Hörstel-Riesenbeck (DE)

( * ) Notice: Subject to any disclaimer, the term of this patent is extended or adjusted under 35 U.S.C. 154(b) by 72 days.

(21) Appl. No.: 13/518,878

(22) PCT Filed: Dec. 22, 2010

(86) PCT No.: PCT/EP2010/007861

§ 371 (c)(1),
(2), (4) Date: Jul. 17, 2012

(87) PCT Pub. No.: WO2011/076399

PCT Pub. Date: Jun. 30, 2011

(65) Prior Publication Data

US 2012/0282793 A1 Nov. 8, 2012

(30) Foreign Application Priority Data

Dec. 23, 2009 (DE) ..... 10 2009 060 564

(51) Int. Cl.
*H01R 13/52* (2006.01)

(52) U.S. Cl.
USPC ..... 439/278

(58) Field of Classification Search
USPC ..... 439/278, 271, 281, 275; 174/76
See application file for complete search history.

(56) References Cited

U.S. PATENT DOCUMENTS

| | | | | | |
|---|---|---|---|---|---|
| 2,369,860 | A | * | 2/1945 | Schroeder | 439/289 |
| 3,757,274 | A | * | 9/1973 | Hazelhurst | 439/281 |
| 3,816,641 | A | * | 6/1974 | Iversen | 174/76 |
| 3,930,705 | A | * | 1/1976 | Gallagher | 439/376 |
| 4,296,992 | A | * | 10/1981 | Gallagher | 439/589 |
| 4,355,855 | A | * | 10/1982 | Rebikoff | 439/275 |
| RE32,864 | E | * | 2/1989 | Ezure | 439/152 |
| 4,874,316 | A | * | 10/1989 | Kamon et al. | 439/39 |
| 4,921,435 | A | * | 5/1990 | Kane et al. | 439/248 |
| 5,295,851 | A | * | 3/1994 | Bawa et al. | 439/273 |
| 5,451,169 | A | * | 9/1995 | Corbett et al. | 439/289 |

(Continued)

FOREIGN PATENT DOCUMENTS

| | | |
|---|---|---|
| DE | 38 40 678 C1 | 2/1990 |
| DE | 197 37 884 A1 | 3/1999 |

(Continued)

*Primary Examiner* — Alexander Gilman
(74) *Attorney, Agent, or Firm* — Gudrun E. Huckett

(57) ABSTRACT

In a plug connection assembly for a moisture-protected electrical plug connection having at least one plug which has a main body (1) having a fastening flange (4) on the front side and a resilient sealing element (7) arranged on said flange and an electric line cable (2) emerging rearward from the main body (1), a contact carrier (5) which receives electric contacts (6) is inserted into the main body (1) in a form-fitting manner. The fastening flange (4) can have a rigid contact area (14) for contact with a socket (9), and the sealing element (7) can have a surface seal (17) and a raised molded seal (27) on a partial surface thereof.

11 Claims, 7 Drawing Sheets

(56) References Cited

U.S. PATENT DOCUMENTS

| | | | | |
|---|---|---|---|---|
| 5,518,415 | A * | 5/1996 | Sano | 439/204 |
| 5,998,772 | A * | 12/1999 | Kirma et al. | 219/541 |
| 6,709,253 | B2 * | 3/2004 | Hattori et al. | 425/116 |
| 6,916,194 | B2 * | 7/2005 | Sichner et al. | 439/271 |
| 6,942,516 | B2 * | 9/2005 | Shimoyama et al. | 439/352 |
| 8,128,422 | B2 * | 3/2012 | Mellott et al. | 439/180 |

FOREIGN PATENT DOCUMENTS

| | | | |
|---|---|---|---|
| DE | 200 21 885 | U1 | 3/2001 |
| EP | 0 134 542 | A1 | 3/1985 |
| EP | 1 239 549 | A1 | 9/2002 |
| EP | 1 241 736 | A1 | 9/2002 |
| WO | 98/53530 | A2 | 11/1998 |

* cited by examiner

PLUG CONNECTION ASSEMBLY FOR A MOISTURE-PROTECTED ELECTRICAL PLUG CONNECTION

BACKGROUND OF THE INVENTION

The invention concerns a plug connection assembly for moisture-protected electrical plug connections or a corresponding plug that comprises a base body with a front-side fastening flange and an elastic sealing element that is arranged thereat as well as an electrical cable that exits at the rear from the base body.

Such a plug is disclosed in DE 197 37 884 A1. Here, the elastic sealing element forms the plug head in which the electrical contacts are guided and supported by means of a special guide. Depending on which type of plug is to be produced and how the electrical contacts are arranged accordingly, different sealing elements and different guides are required. Since in the known plugs the sealing element is a main component, a multitude of different parts must be kept in stock in order to build different plug variants.

Such plug systems are used in particular for control of complex water fountains and must therefore have a high standard with regard to seal-tightness. Preferably, they should even satisfy class IP 68 and be usable under water.

SUMMARY OF THE INVENTION

The object of the invention is therefore to improve a known plug connection assembly of the aforementioned kind in such a way that, while seal-tightness is optimized, the manufacturing expenditure is reduced. This object is solved according to the invention by a plug connection assembly that has a contact carrier that receives electrical contacts inserted with positive fit in the base body.

Because of the positive-fit insertion into the base body of a contact carrier that receives the electrical contacts, the contact carrier becomes a variable component of the plug for different plug variants in addition to the electrical contacts themselves. Also, the base body and the electrical contacts cannot be displaced relative to each other because of the positive-fit guide so that such plugs can be produced with high precision. Preferably, the base body as well as the contact carrier are made of a rigid material, in particular hard plastic material, that ensures exact positioning relative to each other.

In addition to the plugs of DE 197 37 884 A1, plugs are known in practice that by means of a rigid flange and screw connections are pressed against the area that extends circumferentially about a socket. For this purpose, a seal is glued onto the socket. This connection can achieve a good seal-tightness but is not safe with regard to operational errors because, depending on how the screw connection is tightened, the plug can become canted or tilted. When one side of the screw connection is tightened too much, at the opposite side of the flexible seal a gap is inevitably produced and causes leakage.

According to a preferred embodiment, the plug according to the invention can remedy this in that the fastening flange has a rigid contact area for resting against a socket and the sealing element has a flat seal and, on a partial area thereof, has a raised shaped seal. The sealing element is to be configured preferably in this context such that, in the unconnected state of the plug, the flat seal with the socket extends slightly past the contact area of the base body. Upon insertion of the plug into the socket and the relative tightening thereof, for example, by means of a screw connection, the sealing element is then compressed with its flat seal to such an extent that the contact area of the fastening flange comes to rest against the socket. The raised shaped seal is even more compressed when doing so and ensures absolute seal-tightness. The shaped seal should therefore extend preferably completely about the electrical contacts. In a further preferred embodiment, the base body has at the rear of the sealing element a projection that corresponds approximately to the shape of the shaped seal so that an increased pressure is exerted in particular onto the area of the shaped seal.

It is further advantageous when the sealing element is detachably connected to the base body. Since the sealing element is subjected to the highest wear, it can then be exchanged without problem without the entire plug becoming unusable.

As a whole, a particularly good seal-tightness of the plug can be achieved when it is provided with a cavity in the base body that is completely filled with a potting compound. In this way, a capillary blocking action is provided. This is in particular possible with a potting compound of low viscosity that can be filled in preferably through a front-side opening of the contact carrier into the cavity of the base body for which purpose the opening of the contact carrier must extend into this cavity. So that the potting compound does not run out at the rearward end of the plug and no prior securing action with a high-viscosity potting compound is required at the rear, the plug has preferably a rearward seal at the exit area of the cable that surrounds the cable. This rearward seal can be formed in particularly conically and can be pressed from the rear into the base body. It should also be comprised of an elastic material.

In preferred embodiments, the contact element has one or several coding projections and/or coding recesses which interact with corresponding projections or recesses of the associated socket. In this way, different power plugs or also different control plugs can be differentiated and it is avoided that erroneous utilizations occur. In particular, in case of voltage supply wrong polarizations are avoided in this way.

For simplifying mounting of the plug, before it is potted, it is advantageous to provide the contact element with at least one guide projection so that it can be inserted in a safely guided manner into the base body. Also, a support flange of the contact element is expedient with which it is contacting a defined stop of the base body so that always an exact positioning of the electrical contact is realized during mounting.

The invention also concerns a plug connection assembly that comprises an electrical distributor wherein this distributor is characterized in that it is fixedly connected with at least one electrical cable that has at its end the afore described inventive plug.

In practice, only so-called distributor boxes or connection boxes have been used up to now that are either connected with separate cables and plugs, wherein leaks may occur at the connecting locations, or that require on-site connection of the cables to terminals in the distributor box which can lead to errors in assembly. Moreover, the failure probability because of leaks caused during closure of the distributor boxes was very high. This is avoided by the distributor according to the invention with fixedly attached cable and plug. Preferably, the distributor according to the invention is also completely potted so that an absolute seal-tightness is ensured.

Preferably, a plug connection assembly is configured of distributors with two fixedly connected cables wherein one of the cables is a power cable with power plug for power supply and the other is a control cable with control contact plug for controlling the system, in particular through a BUS system. Several such distributors can be connected in series in this way wherein the power supply as well as the control signals are connected through via the individual distributors to the next one, respectively. Each distributor can then control an appropriate consumer, for example, a pump, a water fountain nozzle or the like.

BRIEF DESCRIPTION OF THE DRAWINGS

Further advantages and details result, in addition to the dependent claims, from a preferred embodiment of the invention which will be explained in the following. It is shown in:

DESCRIPTION OF PREFERRED EMBODIMENTS

Figure 1:
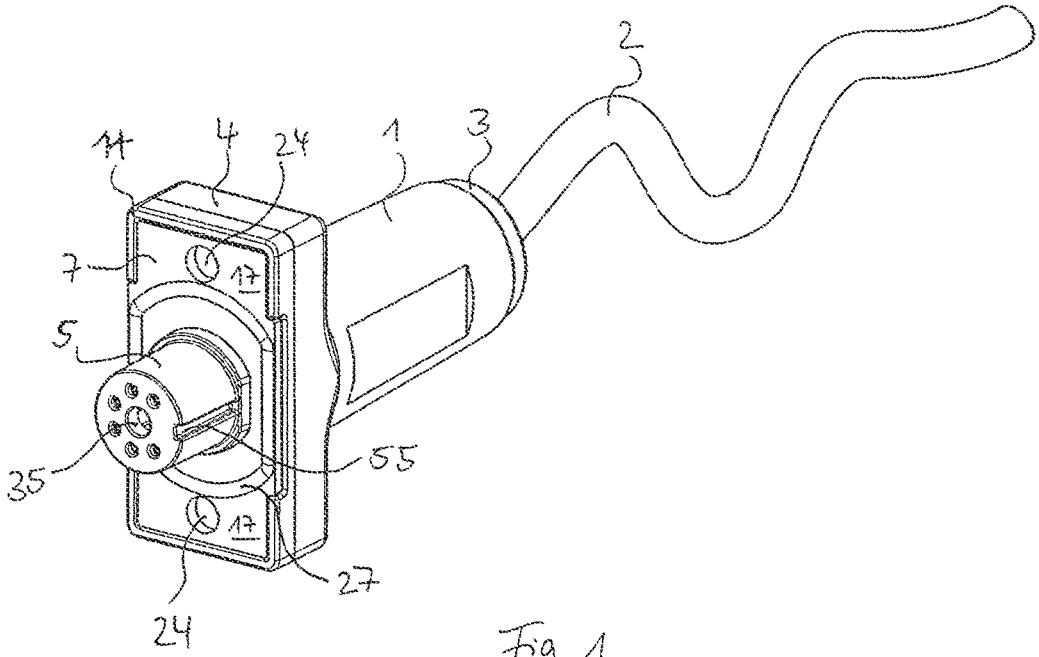
FIG. 1 a plug according to the invention in a perspective view.
Figure 2:
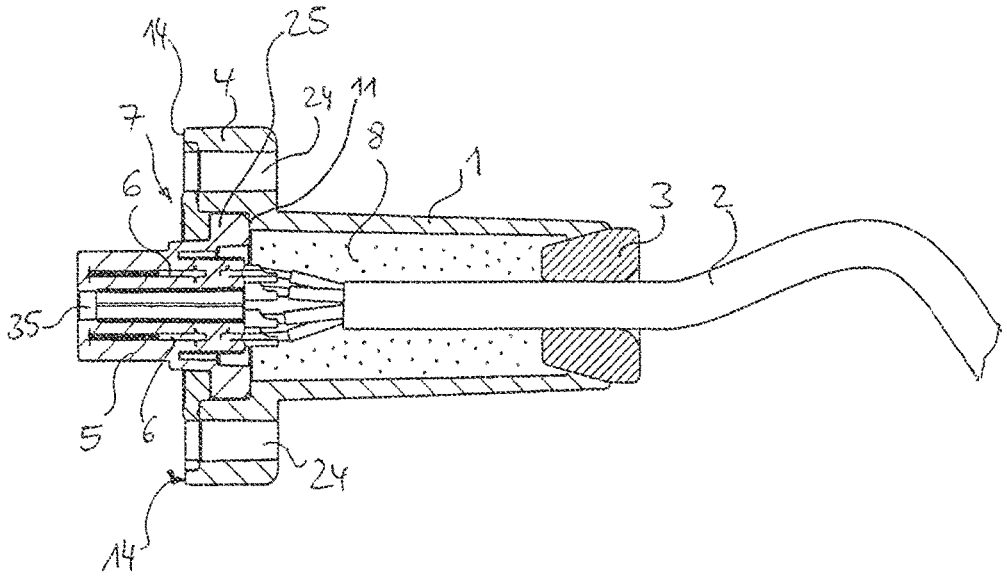
FIG. 2 a section view of the article according to FIG. 1.

The plug that is illustrated in FIGS. 1 and 2 has a base body 1 from which rearwardly a sheathed electrical cable 2 extends. The sealing action at the rear is realized by an elastic sealing plug 3. The base body has at the front side a fastening flange 4. In the base body a contact carrier 5 or plug insert is inserted with positive fit. The contact carrier 5 supports the electrical contact pins 6 that are connected with the cable 2.

The fastening flange 4 has a rigid contact area 14 for resting against a socket; this will be explained later on with the aid of FIG. 4. On the fastening flange 4, or in the latter, an elastic sealing element 7 is received that has a flat seal 17 and a forwardly projecting raised shaped seal 27.

Mounting of the plug according to the invention will be explained with the aid of FIG. 3. For this purpose, the contact carrier 5 is provided with the electrical contacts 6 and the cable 2 and inserted into the base body 1. For this purpose, the contact carrier, as illustrated, preferably has guide projections 15 that facilitate the exact insertion into a corresponding opening of the base body 1. Moreover, the contact carrier 5 has a circumferentially extending support flange 25 that, in the mounted state, comes to rest against a defined stop 11 of the base body 1. In this way, the contact carrier 5 is exactly positioned. The flange 25 is preferably not of a circular ring shape but is flattened at two lateral areas so that the plug can be used with a minimal space requirement and several plugs can be mounted adjacent to each other in a simple way in a multi-socket component (see FIG. 7).

Figure 3:
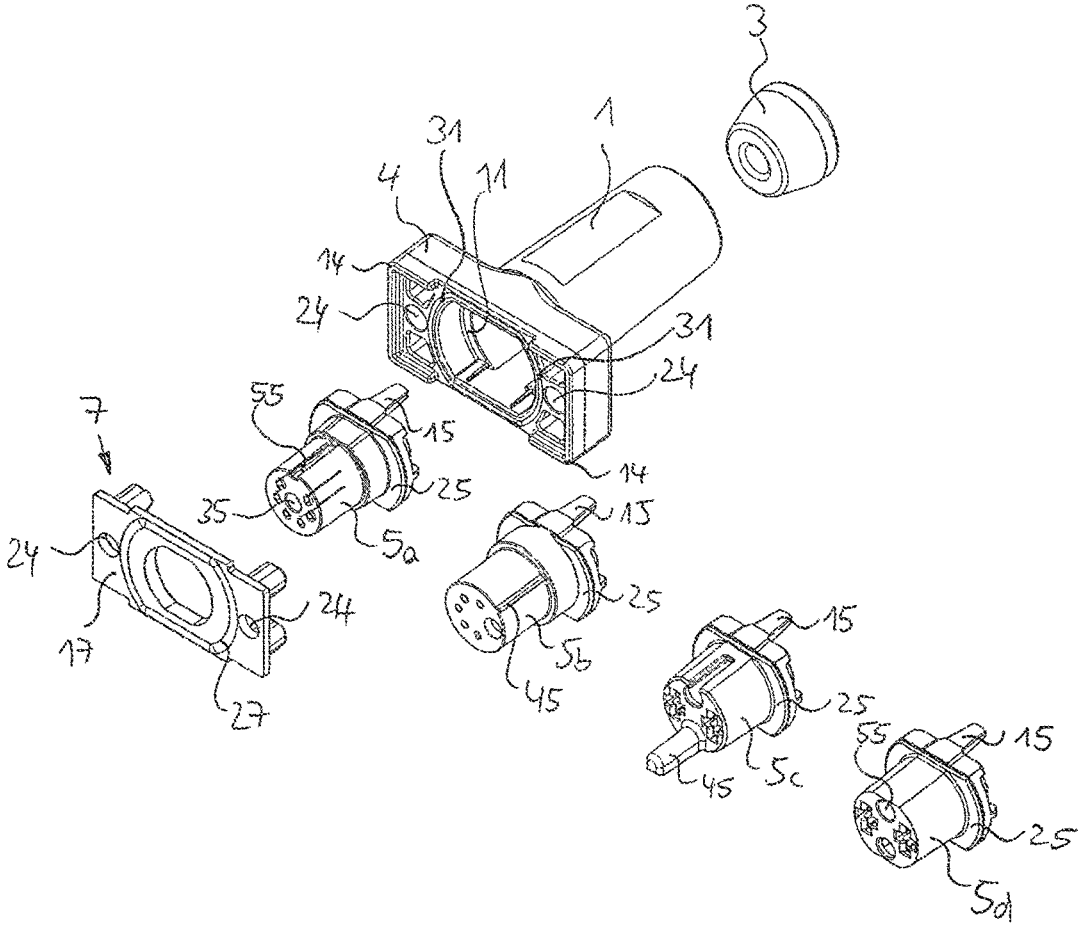
FIG. 3 an exploded view of the important plug elements with different contact carriers.

The cable 2, not illustrated in FIG. 3, is now passed through and the seal 3 is forced into the rear of the base body. The base body is thus closed at the rear. From the front side/topside through an opening 35 provided for this purpose, see FIG. 2, the potting compound 8 can be filled into the inner cavity of the base body 1 so that capillary action along the cable 2 and the electrical contacts 6 as well as leaks can be avoided.

For sealing relative to a socket, the front side of the base body is provided with an elastic sealing element 7 that is preferably not glued onto the base body 1 but is only inserted into it. In this way, the elastic sealing element 7 that is subject to greatest wear can be exchanged any time without great effort.

FIG. 3 shows in exemplary fashion four different variants of the contact carriers 5. They each have coding projections 45 or coding recesses 55. In interaction with corresponding counter recesses or counter projections, not illustrated, provided at the respective sockets, they serve to ensure that the plugs can be inserted only into the matching or associated sockets.

Figure 4:
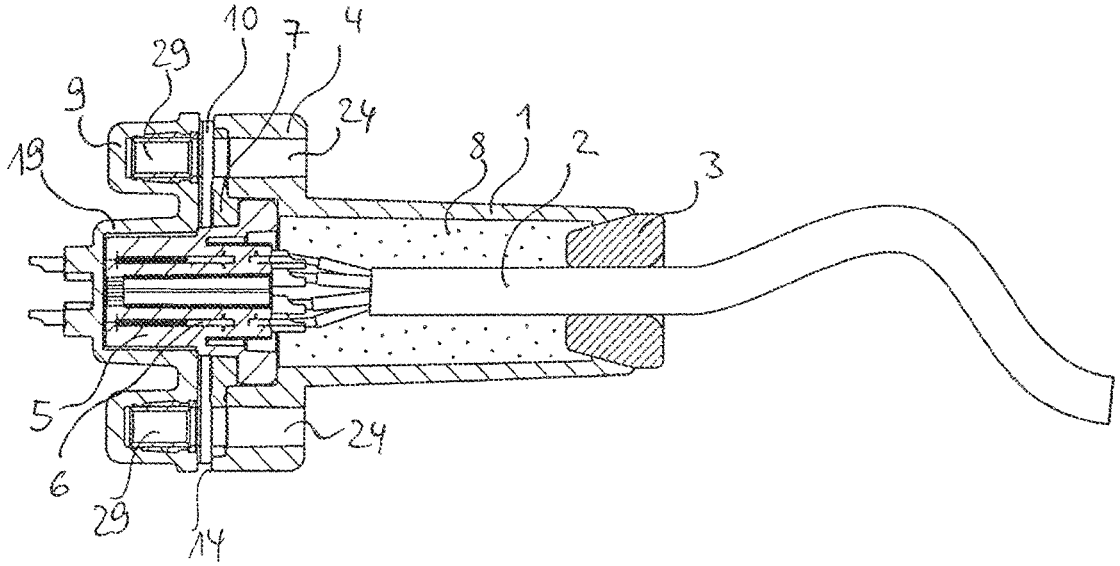
FIG. 4 the article of FIG. 2 inserted into a socket.

FIG. 4 shows the plug of FIG. 2, inserted into a socket 9. In this connection, the contact carrier 5 with its electrical contact pins 6 is inserted into a corresponding receptacle 19 of the socket 9. The fastening flange 4 of the plug base body 1 comes into contact by means of its rigid contact area 14 with a contact surface 10 of the socket 9. For attachment, screws, not illustrated, pass through screw cutouts 24 of the fastening flange 4 and engage threads 29 of the socket 9. In doing so, the flat seal 17 that in the non-inserted state according to FIG. 1 projects slightly past the rigid contact area 14 of the fastening flange 4 is compressed so that the rigid contact area 14 is resting tightly against the contact surface 10. Also compressed is the projecting shaped seal 27 that in this way provides an absolutely water-tight sealing action in the transition area between plug and socket 9. This is even more enhanced when the base body 1, as preferred and as illustrated in FIG. 3, has a projection 31 at its front side that is facing the sealing element 7 and matches the shape of the shaped seal 27, by means of which the shaped sea 127 is even more tightly pressed. Even when the fastening screw connection is non-uniform or is tightened too much at one side, no canting of the plug and no leakage resulting therefrom can result because of the rigid contact area 14.

Figure 5:
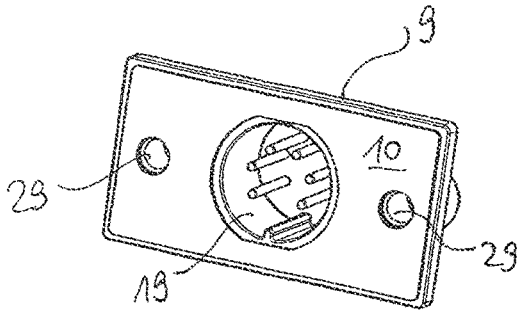
FIG. 5 a plan view of the socket without plug.
Figure 6:
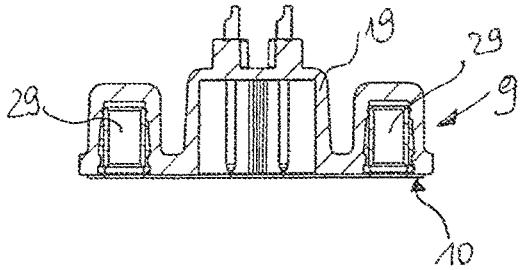
FIG. 6 the article of FIG. 5 in section view.
Figure 7:
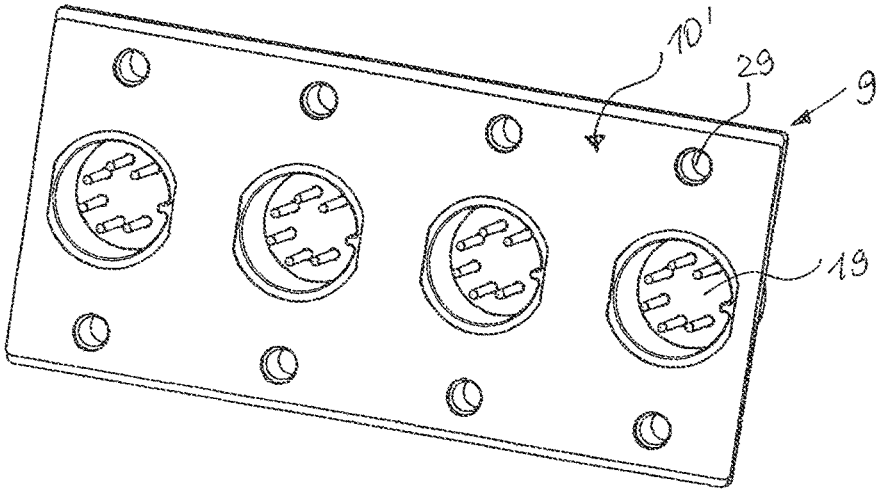
FIG. 7 a component with several sockets.

FIG. 5 shows a plan view onto the socket 9 without inserted plug and FIG. 6 shows a section view of the article of FIG. 5, also without plug. In FIG. 7 a contact surface 10' is illustrated that is of a different design and that engages simultaneously across four sockets.

Figure 8A:
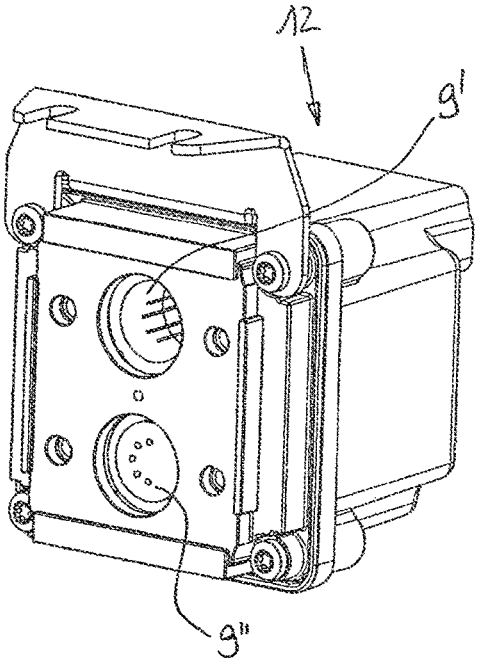
FIG. 8 two electrical distributor boxes with one or two sockets, respectively.
Figure 8B:
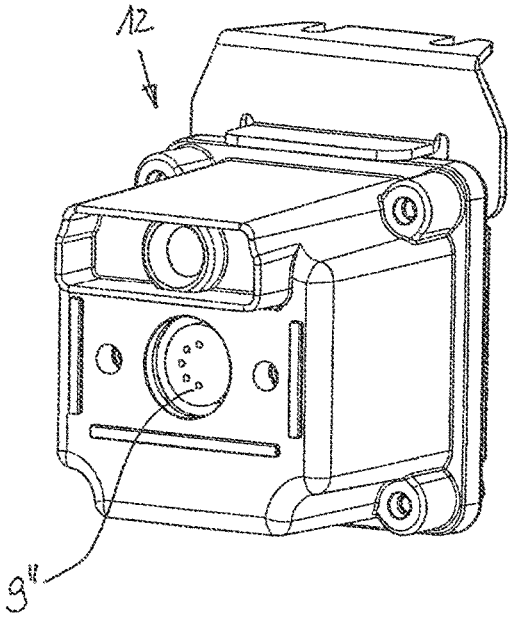

FIG. 8 shows the front and rear views of an electrical distributor or a distributor box or connection box 12. It has at the front side an input socket 9' into which the plug of FIG. 1 can be inserted and on the front side and the rear an output socket 9", respectively. The distributor box or connection box 12 is preferably completely potted as a water-tight unit. Since by means of the plugs according to the invention in a simple way absolutely watertight electrical connections can be realized, it is not necessary in case of the corresponding boxes 12 according to the invention to provide openings where the cables, on site, must be mounted or connected to terminals, as is the case in the aforementioned known distributor or connection systems. The box 12 illustrated in FIG. 8 serves for receiving and conducting electrical control voltages. The latter are supplied to the box 12 through the input socket 9' and leave it at the rearward output socket 9" toward a device connected thereto, for example, a pump or a water fountain. By means of the further front-side output socket 9" the signals can be connected through and transmitted to a further distributor box connected thereto. This control can be preferably done by means of a data BUS.

Figure 9A:
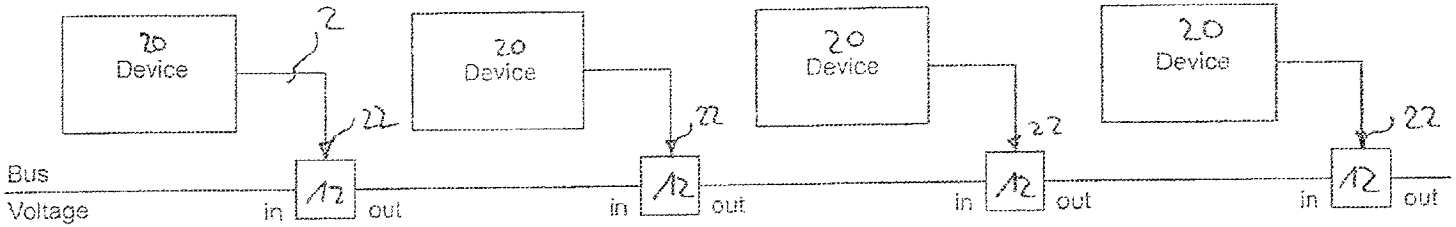
FIG. 9 schematically two distributor systems with distributor boxes.
Figure 9B:
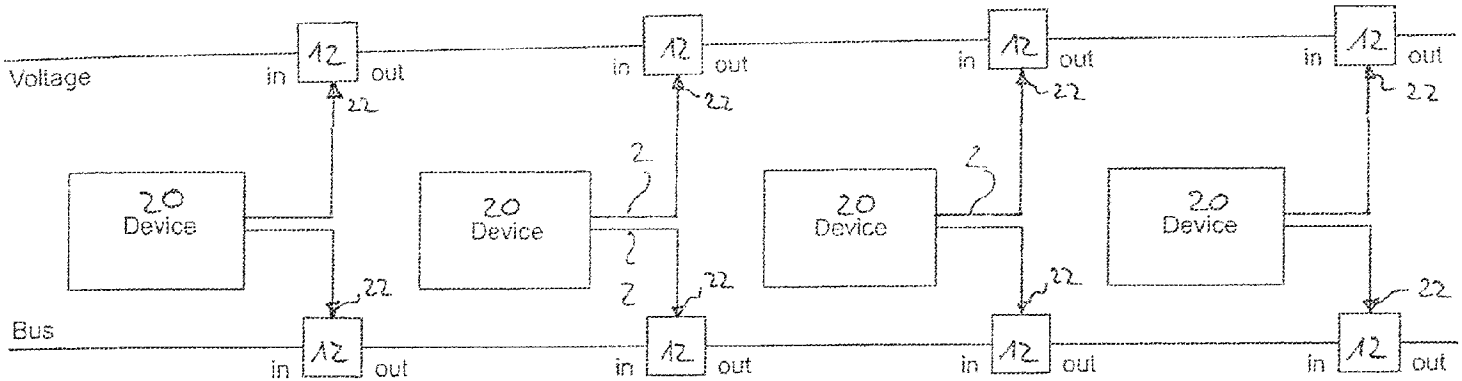

FIG. 9 shows schematically how such distributors 12 are series-connected for power supply or control, for example, of various nozzles 20. In FIG. 9*a* only one of these chains is illustrated while FIG. 9*b* shows connection of the devices 20 by two chains of distributor boxes 12 of which one serves for power supply and the other for control.

For this purpose, the consumer devices 20 are preferably provided with two cables 21 that are fixedly connected to the devices 20 and two plugs 22 according to the invention that each are inserted into a socket 8 of the distributor box 12 and are secured thereat by the special configuration in a water-tight way.

The plug connection assembly according to the invention is suitable in a special way for flexible configuration of water fountains wherein the corresponding plugs can be produced in a broad variant range inexpensively and, in connection with the electrical distributors 12, 13, provide an easily mountable and water-tight unit that has an extremely small tendency to fail.

What is claimed is:

1. A plug connection assembly for a moisture-protected electrical plug connection comprising:

at least one plug that comprises a base body, said base body comprising a front-side fastening flange and an elastic sealing element arranged at said front-side fastening flange;

an electrical cable having a first end disposed in said base body and exiting from said base body through an exit area at a rear of said base body;

a contact carrier, provided with electrical contacts, received with positive fit in said base member;

wherein said fastening flange has a rigid contact area configured to rest against a socket of the plug connection assembly and wherein said sealing element has a flat seal and a raised shaped seal disposed on a partial surface of said flat seal, wherein said sealing element seals relative to the socket to protect the electrical plug connection from moisture when the at least one plug and the socket are connected.

2. The plug connection assembly according to claim 1, wherein said sealing element is secured exchangeably on said base body.

3. The plug connection assembly according to claim 1, wherein said contact carrier has at least one front-side opening for filling in a potting compound into a cavity of said base body.

4. The plug connection assembly according to claim 1, wherein said at least one plug has a rearward seal disposed in said exit area at said rear of said base body.

5. The plug connection assembly according to claim 1, wherein said contact carrier has at least one coding projection.

6. The plug connection assembly according to claim 1, wherein said contact carrier has at least one coding recess.

7. The plug connection assembly according to claim 1, wherein said contact carrier has at least one coding projection and at least one coding recess.

8. The plug connection assembly according to claim 1, wherein said contact carrier has at least one guide projection for guiding said contact carrier on said base body during insertion into said base body.

9. The plug connection assembly according to claim 1, wherein said base body has a defined stop and said contact carrier has a support flange resting against said defined stop.

10. The plug connection assembly according to claim 1, comprising a distributor, wherein said distributor has at least three sockets for receiving said at least one plug.

11. The plug connection assembly according to claim 10, wherein said at least three sockets are configured for receiving and transmitting electrical power or electrical control voltage.

* * * * *